US009943772B2

(12) United States Patent
Bethers

(10) Patent No.: US 9,943,772 B2
(45) Date of Patent: Apr. 17, 2018

(54) MOBILE ACTION SPORTS RAMP

(71) Applicant: John Bethers, Provo, UT (US)

(72) Inventor: John Bethers, Provo, UT (US)

( * ) Notice: Subject to any disclaimer, the term of this patent is extended or adjusted under 35 U.S.C. 154(b) by 0 days.

(21) Appl. No.: 15/426,943

(22) Filed: Feb. 7, 2017

(65) Prior Publication Data

US 2017/0296940 A1 Oct. 19, 2017

Related U.S. Application Data

(63) Continuation of application No. 15/130,092, filed on Apr. 15, 2016, now Pat. No. 9,561,448.

(51) Int. Cl.

| | |
|---|---|
| ***A63C 19/10*** | (2006.01) |
| ***A63J 3/00*** | (2006.01) |
| *B65G 69/00* | (2006.01) |

(52) U.S. Cl.

CPC ..... *A63J 3/00* (2013.01); *A63C 19/10* (2013.01); *A63G 2200/00* (2013.01)

(58) Field of Classification Search

CPC ..... A63C 2203/10; A63B 69/0022; A63B 69/0093; A63B 69/18; A63B 9/00; A63B 2009/006; A63B 2210/50; B65G 69/00; B65G 69/28; B65G 69/30; B65G 69/2811; E04F 11/00; E04F 11/002; E04F 2011/005

USPC ..... 472/3, 88–91; 482/34–36; 14/69.5, 70

See application file for complete search history.

(56) References Cited

U.S. PATENT DOCUMENTS

| | | | | |
|---|---|---|---|---|
| 4,423,864 | A * | 1/1984 | Wiik | A63B 22/0012 434/253 |
| 5,749,615 | A | 5/1998 | Itson | |
| 5,947,502 | A * | 9/1999 | Kammerzell | B60P 3/0252 108/143 |
| 2008/0293505 | A1* | 11/2008 | Northam | A63G 31/007 472/90 |
| 2010/0197416 | A1* | 8/2010 | Brown | A63C 19/10 472/90 |

* cited by examiner

*Primary Examiner* — Kien Nguyen

(74) *Attorney, Agent, or Firm* — Seth Black; Dodd Call Black, PLLC

(57) ABSTRACT

One example embodiment includes a mobile action sports ramp. The mobile action sports ramp includes an incline portion connected to a vehicle portion by a hinge. The incline portion includes a lower incline portion connected to an upper incline portion by a hinge. The lower incline portion folds onto the upper incline portion and the incline portion then rests upon the vehicle portion when the mobile action sports ramp is collapsed and capable of transportation. The lower incline portion unfolds into alignment with the upper incline portion and the incline portion then raises up when the mobile action sports ramp is erected and capable of use in various action sports. Methods for erecting and collapsing a mobile action sports ramp are also provided.

18 Claims, 13 Drawing Sheets

MOBILE ACTION SPORTS RAMP

CROSS REFERENCE TO RELATED APPLICATIONS

This application is a continuation of U.S. application Ser. No. 15/130,092 filed Apr. 15, 2016. The entire content of the foregoing application is hereby incorporated by reference in its entirety.

BACKGROUND

1. Technical Field

The present invention relates to ramps for action sports. More specifically, the present invention relates to a mobile action sports ramp and methods for erecting and collapsing such a ramp.

2. Background and Relevant Art

Over the last several decades, action sports have been increasing in popularity, due in large part to the entertainment such activities provide spectators and the enjoyment such activities provide athletes. In general, action sports (also known as "extreme sports" or "adventure sports") typically refers to certain activities perceived as having a high level of inherent danger. Such activities often involve fast speeds, great heights, significant levels of physical exertion, and highly specialized gear. Action sports also includes motorized and non-motorized activities. Examples of some action sports include, but are not limited to, auto racing, BASE jumping, bungee jumping, freeskiing, hang gliding, ice climbing, kitesurfing, mountain biking, rock climbing, skydiving, snowboarding, and surfing, among others.

In some instances, certain action sports often involve the use of ramps that provide a slope or incline that joins two different levels or heights. For example, a drop-in ramp typically allows an athlete to gain speed by traveling down the drop-in ramp. In contrast, a jump ramp usually allows an athlete to jump over an obstacle or section of ground by traveling up the jump ramp. Freestyle motocross, freestyle skateboarding, and freestyle bicycle motocross (also known as "freestyle BMX") are examples of action sports that often involve the use of such ramps.

Consequently, as the popularity of action sports has grown, so has the need for ramps used in certain action sports. However, typical ramps suffer from a number of drawbacks. For example, oftentimes ramps are built specifically for a single action sports event that takes place at a single location. Building ramps for a single action sports event at a single location usually involves significant setup costs, considerable manual labor, and a substantial investment of time. More specifically, ramps for action sports events are often built with a poor design using standard construction techniques that are expensive, slow, and require numerous workers. Moreover, such ramps are usually neither collapsible nor mobile. Furthermore, it is often the case that scaffolding is required to build and assemble action sports ramps. Accordingly, because of the substantial cost, labor, and time involved, building ramps for a single action sports event at a single location is often not conducive to touring shows featuring action sports that make use of ramps.

In addition, typical ramps often lack adequate stability, safety features, and riding surfaces. This is also usually the result of poor ramp design that uses standard construction techniques and materials to build the ramps. Poor stability, missing safety features, and undesirable riding surfaces also typically arise due to having ramps built by workers who are not well-versed or otherwise knowledgeable about the demands of the action sports and the needs of the athletes using the ramps.

Accordingly, there is a need in the art for an action sports ramp that reduces the cost, labor, and time required for ramp setup. In addition, there is a need in the art for an action sports ramp that is collapsible and mobile. Furthermore, there is a need in the art for an action sports ramp that provides improved stability, safety features, and riding surfaces.

SUMMARY

According to the teachings of the present invention, a mobile action sports ramp includes a vehicle portion having a vehicle frame connected to a vehicle base and an incline portion connected to the vehicle portion. In at least one embodiment of such a mobile action sports ramp, the incline portion includes an upper incline portion connected to the vehicle frame by a first hinge, the upper incline portion being rotatable about the first hinge, a platform portion connected to the upper incline portion, and a lower incline portion connected to the upper incline portion by a second hinge, the lower incline portion being rotatable about the second hinge.

Furthermore, the inventive mobile action sports ramp may include other features. In some embodiments, the mobile action sports ramp includes a first stairway integrated within the lower incline portion and a second stairway integrated within the upper incline portion. One or more embodiments of the mobile action sports ramp further include a first truss positioned on a first exterior side of the upper incline portion and connected to a first side of the second stairway, a second truss positioned internally in the upper incline portion and connected to a second side of the second stairway and a ramp surface of the upper incline portion, a third truss positioned internally in the upper incline portion and connected to the ramp surface of the upper incline portion, and a fourth truss positioned on a second exterior side of the upper incline portion and connected to the ramp surface of the upper incline portion.

Moreover, certain embodiments of the mobile action sports ramp include a guardrail connected to the incline portion. Still further, various embodiments of the present invention include a ramp transition incline hingedly connected to the lower incline portion. Optionally, embodiments of the mobile action sports ramp also include a ramp exit incline and a transition incline support member hingedly connected to the ramp transition incline such that, when the mobile action sports ramp is erect, the transition incline support member supports the ramp transition incline and the ramp exit incline and, when the mobile action sports ramp is collapsed, the transition incline support member folds to be stored within the lower incline portion and the ramp exit incline is stored on the vehicle portion.

One or more embodiments of the mobile action sports ramp also include a first member hingedly connected to the vehicle frame, the first incline portion support member being rotatable between a first position resting laterally upon the vehicle frame and a second position standing substantially vertical above the vehicle frame, and a second incline portion support member hingedly connected to the incline portion, the second incline portion support member being rotatable between a first position substantially parallel the upper incline portion and a second position standing substantially vertical below the incline portion.

Furthermore, at least one embodiment of the present invention includes a vehicle portion support member such that, when the mobile action sports ramp is erect, the vehicle portion support member connects to the vehicle frame and extends outwardly from the vehicle portion to provide support and, when the mobile action sports ramp is collapsed, the vehicle portion support member is stored on the vehicle portion. Certain embodiments of the mobile action sports ramp also include a hinge block connected to the upper incline portion such that, when the mobile action sports ramp is erect, the hinge block supports the lower incline portion and aligns the lower incline portion with the upper incline portion. Additionally, embodiments of the mobile action sports ramp include a vehicle portion that is a non-motorized vehicle. Alternatively, other embodiments include a vehicle portion that is a motorized vehicle.

According to another aspect of the present invention, a method for erecting a mobile action sports ramp includes the step of unfolding an incline portion of the mobile action sports ramp by rotating a lower incline portion of the incline portion about a first hinge that connects the lower incline portion to an upper incline portion of the incline portion, the step of raising the incline portion by rotating the upper incline portion about a second hinge that connects the upper incline portion to a vehicle portion of the mobile action sports ramp, and the step of attaching a ramp exit incline to the lower incline portion such that the incline portion provides a continuous ridable surface from a platform portion of the incline portion to an end of the ramp exit incline.

Moreover, the inventive method for erecting the mobile action sports ramp may involve additional steps. One or more embodiments of such a method includes the step of stabilizing the vehicle portion by attaching a vehicle portion support member to the vehicle portion such that the vehicle portion support member extends outwardly from the vehicle portion to a support surface. Additionally, various embodiments involve the step of supporting the incline portion by connecting a first incline portion support member from the vehicle portion to the incline portion and connecting a second incline portion support member from the incline portion to the vehicle portion. One or more embodiments also include the step of unfolding a guardrail of the incline portion such that the guardrail is substantially upright. Still further, certain embodiments of the method of erecting the mobile action sports ramp include the step of unfolding a transition incline support member of the lower incline portion to support the ramp exit incline and a ramp transition incline of the lower incline portion.

According to yet another aspect of the present invention, a method for collapsing a mobile action sports ramp includes the step of detaching a ramp exit incline from an incline portion of the mobile action sports ramp, the step of lowering the incline portion by rotating an upper incline portion of the incline portion about a first hinge that connects the upper incline portion to a vehicle portion of the mobile action sports ramp, and the step of folding the incline portion by rotating a lower incline portion of the incline portion about a second hinge that connects the lower incline portion to the upper incline portion.

Furthermore, the inventive method for collapsing the mobile action sports ramp can include other steps. At least one embodiment of such a method includes the step of attaching the ramp exit incline to the vehicle portion. One or more embodiments also include the step of rotating a ramp transition incline of the incline portion such that the ramp transition incline is stored within the lower incline portion and the step of folding a transition incline support member of the lower incline portion such that the transition incline support member is stored within the lower incline portion. Various embodiments also include the step of folding a guardrail of the incline portion such that the guardrail is substantially laying on the incline portion. Also, one or more embodiments of the method for collapsing the mobile action sports ramp include the step of folding a first incline portion support member onto the vehicle portion and folding a second incline portion support member into the incline portion.

In light of the foregoing, additional features and advantages of exemplary embodiments will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description, or may be learned by the practice of such exemplary embodiments as set forth hereinafter.

BRIEF DESCRIPTION OF THE DRAWINGS

In order to describe the manner in which the above recited and other advantages and features can be obtained, a more particular description will be rendered by reference to specific embodiments thereof that are illustrated in the appended drawings. It should be noted that the figures are not drawn to scale, and that elements of similar structure or function are generally represented by like reference numerals for illustrative purposes throughout the figures. Understanding that these drawings depict only typical embodiments and are not therefore to be considered to be limiting, such embodiments will be described and explained with additional specificity and detail through the use of the accompanying drawings in which.

DETAILED DESCRIPTION

Embodiments of the present invention reduce the cost, labor, and time associated with erecting a ramp for use in action sports. Furthermore, such embodiments provide a collapsible and mobile action sports ramp. Moreover, embodiments of the present invention improve the stability, safety, and riding surfaces of ramps used in action sports. For example, one or more aspects of the present invention include, but are not limited to, vehicle portion support members (e.g., outriggers), integrated stairs, guardrails, curved ramp transition surfaces, and powered erection and collapsing of the ramp (e.g., using a winch or other mechanical actuator, such as a hydraulic cylinder).

Figure 1A:
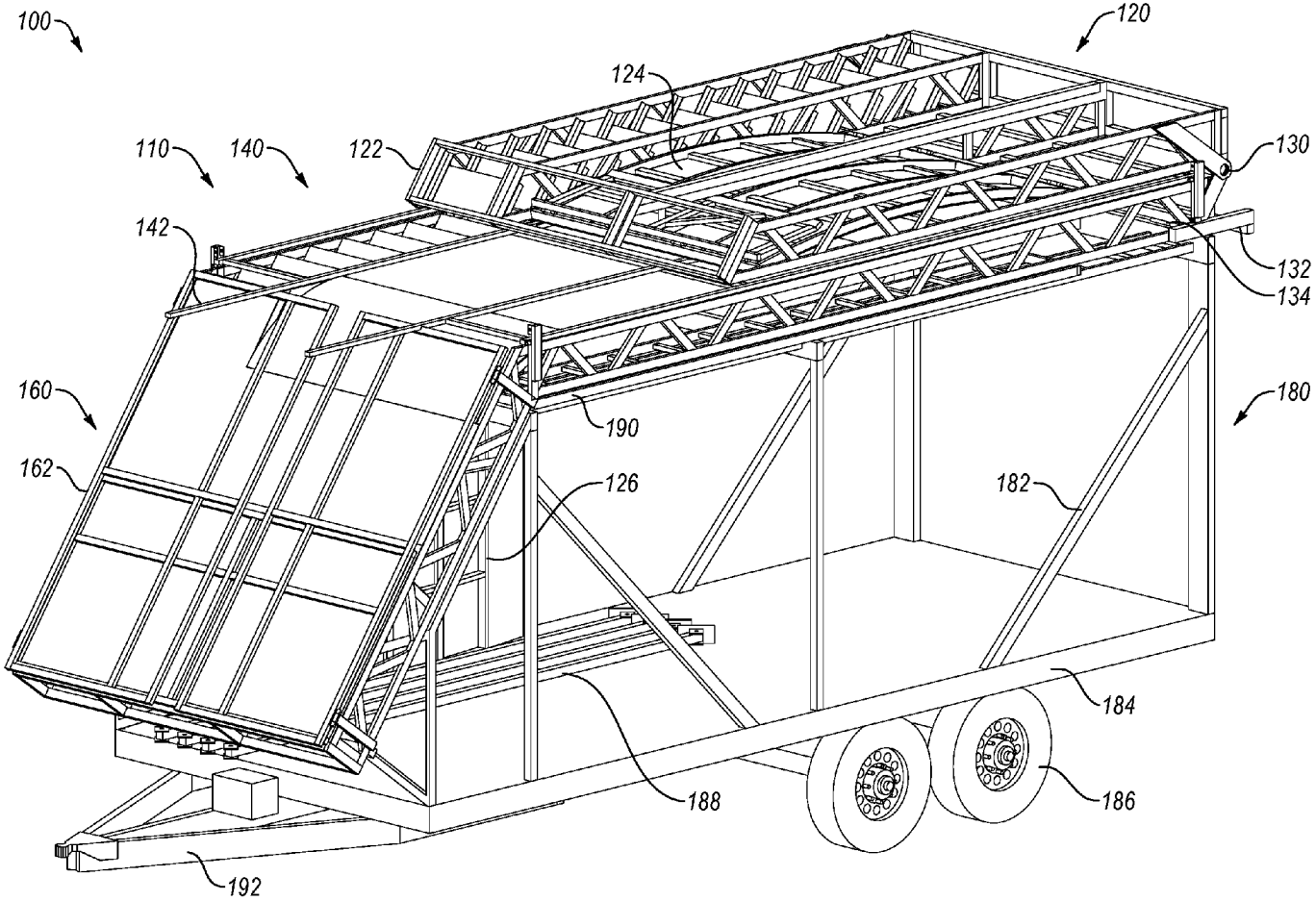
FIG. 1A is a perspective view of a mobile action sports ramp in a collapsed state in accordance with embodiments of the present invention.

FIG. 1A is a perspective view of a mobile action sports ramp 100 in a collapsed state in accordance with embodiments of the present invention. When in a collapsed state, mobile action sports ramp 100 can be transported from one location to another.

As FIG. 1A illustrates, mobile action sports ramp 100 includes an incline portion 110 mounted on a vehicle portion 180. Incline portion 110 generally forms the incline of the action sports ramp, whereas vehicle portion 180 is generally employed to make the ramp mobile and transportable. Accordingly, as shown by FIG. 1A, vehicle portion 180 can include a non-motorized vehicle, such as a trailer with a hitch 192. In alternative embodiments of the present invention, vehicle portion 180 can include a motorized vehicle, such as a truck.

Furthermore, as FIG. 1A illustrates, vehicle portion 180 includes vehicle frame 182, vehicle base 184, and vehicle propulsion unit 186. In one or more embodiments, vehicle frame 182 is generally in the shape of a rectangular box mounted on vehicle base 184 to support incline portion 110 (e.g., a metal cage). As shown in FIG. 1A, vehicle frame 182 is open, however, in alternative embodiments, vehicle frame 182 could be enclosed (e.g., like the frame of an enclosed trailer). Moreover, vehicle frame 182 provides an area or cavity for the storage of portions of the mobile action sports ramp 100, such as a ramp exit incline 126 and one or more vehicle portion support members 188. Additionally, the area or cavity formed by vehicle frame 182 allows for the storage and transportation of additional cargo, including action sports gear (e.g., skateboards, bikes, etc.) or other items used when performing action sports on a tour.

FIG. 1A further shows that vehicle base 184 can include a base of a flatbed trailer. However, in other embodiments, vehicle base 184 can include a base of an enclosed trailer or a chassis of a motorized vehicle. FIG. 1A also illustrates that vehicle propulsion unit 186 can include tires and wheels connected by one or more axels. In other embodiments, vehicle propulsion unit 186 can include a continuous track (e.g., as on tank). As also shown by FIG. 1A, vehicle portion 180 can include one or more incline portion support members 190 which fold flat onto the top of vehicle frame 182 when the mobile action sports ramp 100 is in a collapsed state.

As further shown by FIG. 1A, incline portion 110 can include a lower incline portion 120, an upper incline portion 140, and a platform portion 160. In the embodiment shown in FIG. 1A, lower incline portion 120 is connected to upper incline portion 140 by a hinge 130. Furthermore, lower incline portion 120 includes a foot 122 that is angled to make substantially flat contact with a support surface (i.e., the ground) when the mobile action sports ramp 100 is erect. Lower incline portion 120 can also store a ramp transition incline 124. In one or more embodiments, ramp transition incline 124 is pivotally connected to lower incline portion 120 such that it can rotate in-between two or more trusses of lower incline portion 120 to be stored when the mobile action sports ramp 100 is in a collapsed state. In alternative embodiments, a ramp transition incline 124 can be stored in the vehicle portion 180 in a manner similar to that of ramp exit incline 126 shown in FIG. 1A.

Additionally, FIG. 1A illustrates that upper incline portion 140 is connected to vehicle frame 182 by hinge 134. Upper incline portion 140 can also include a hinge block 132 which is used to support the lower incline portion 120 as the mobile action sports ramp 100 is erected. In one or more embodiments, upper incline portion 140 can also include one or more guardrails 142 which fold flat onto the top of upper incline portion 140 when the mobile action sports ramp 100 is in a collapsed state. Along similar lines, FIG. 1A shows that platform portion 160 can include one or more guardrails 162 which fold flat onto the top of platform portion 160 when the mobile action sports ramp 100 is in a collapsed state.

Figure 1B:
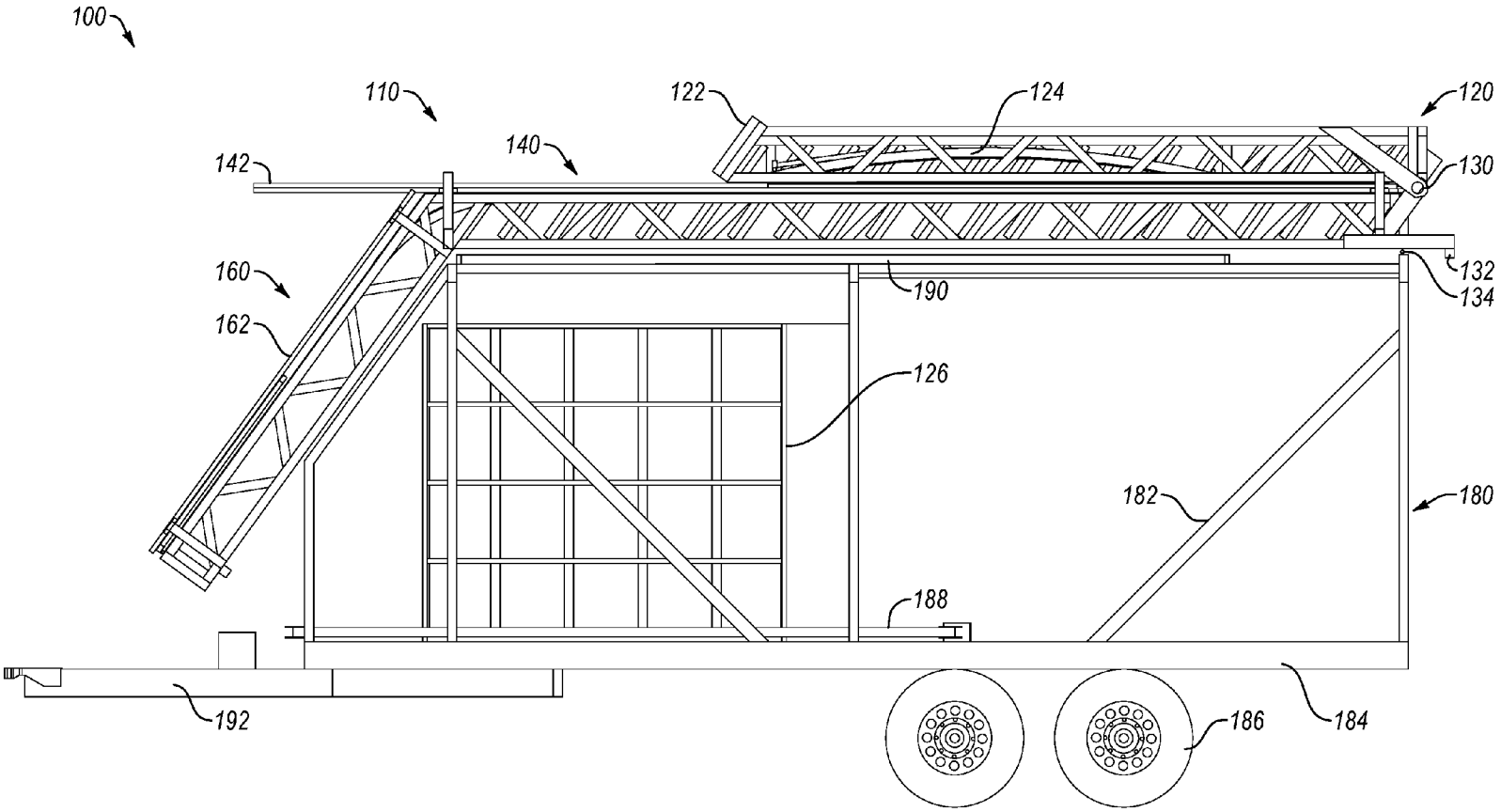
FIG. 1B is a left side view of the mobile action sports ramp of FIG. 1A in accordance with embodiments of the present invention.

FIG. 1B is a left side view of the mobile action sports ramp 100 of FIG. 1A in accordance with embodiments of the present invention. As FIG. 1B illustrates, incline portion 110, and more particularly upper incline portion 140, is connected to vehicle frame 182 of vehicle portion 180 by hinge 134. In addition, FIG. 1B shows that one or more guardrails 142 of upper incline portion 140 can extend beyond the length of upper incline portion 140. In one or more embodiments, this allows the top edge of one or more guardrails 142 to meet up with the top edge of one or more guardrails 162 of platform portion 160 when one or more guardrails 142 and one or more guardrails 162 are unfolded (i.e., setup and placed into a position that provides enhanced safety, such as when the mobile action sports ramp 100 is erect). Moreover, FIG. 1B illustrates that, when mobile action sports ramp 100 is in a collapsed state, lower incline portion 120 folds on top of one or more guardrails 142. In turn, one or more guardrails 142 fold on top of upper incline portion 140 and upper incline portion 140 then, in turn, folds on top of vehicle frame 182 of vehicle portion 180, which may further include folding on top of one or more incline portion support members 190.

FIG. 1B also shows that ramp transition incline 124 is stored within lower incline portion 120. In addition, FIG. 1B illustrates that ramp exit incline 126 and one or more vehicle portion support members 188 are stored on vehicle portion 180 within vehicle frame 182.

Figure 1C:
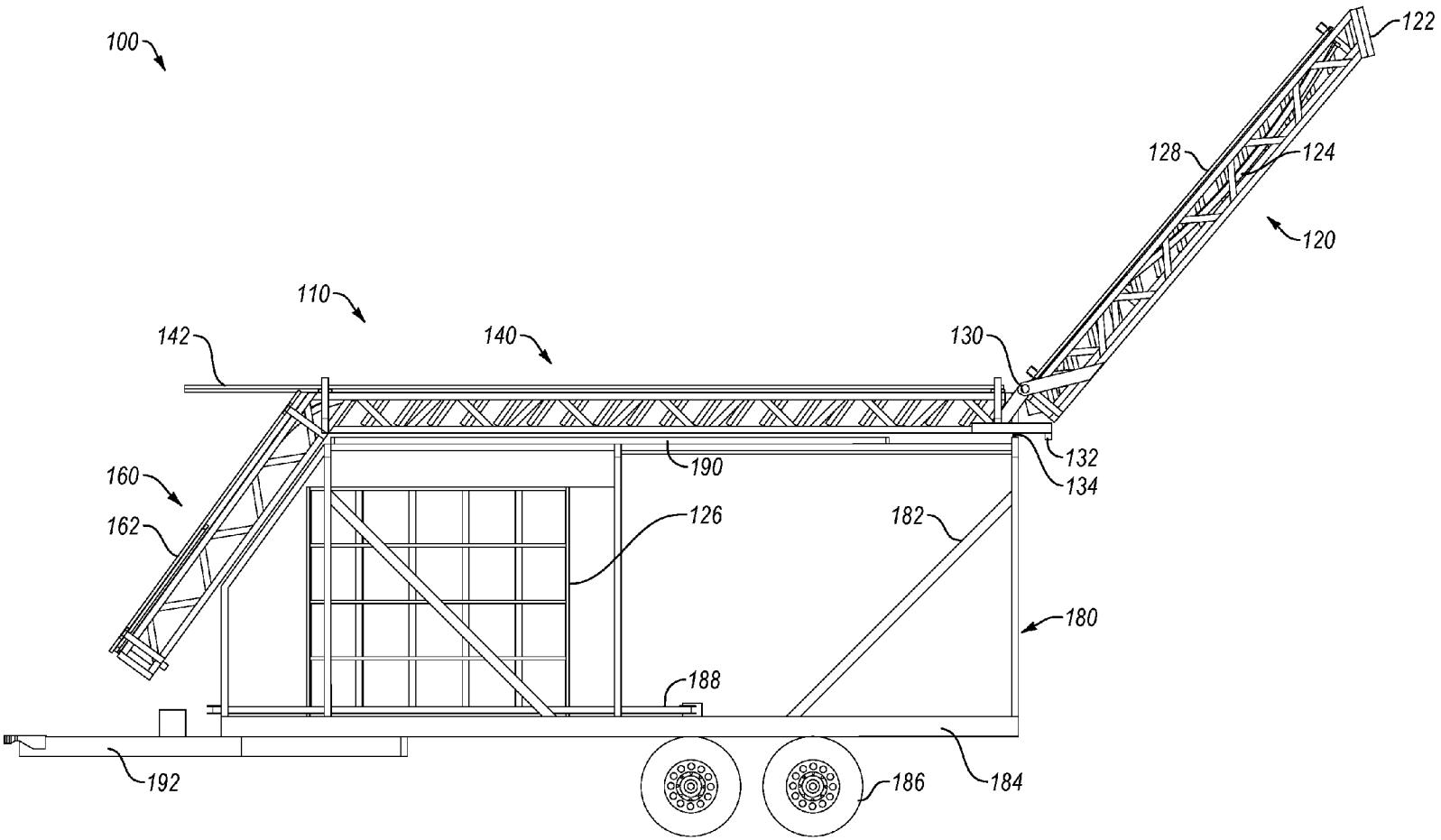
FIG. 1C is a left side view of the mobile action sports ramp of FIG. 1A in a first state of a process of erecting the mobile action sports ramp in accordance with embodiments of the present invention.

FIG. 1C is a left side view of the mobile action sports ramp 100 of FIG. 1A in a first state of a process of erecting the mobile action sports ramp 100 in accordance with embodiments of the present invention. In particular, FIG. 1C illustrates that in order to erect mobile action sports ramp 100, lower incline portion 120 is unfolded from upper incline portion 140 by rotating lower incline portion 120 about hinge 130. In one or more embodiments, manual labor is employed to unfold lower incline portion 120 and rotate lower incline portion 120 away from upper incline portion 140. In alternative embodiments, a mechanical actuator (e.g., hydraulic, pneumatic, electric, or mechanical) is employed to unfold lower incline portion 120 and rotate lower incline portion 120 away from upper incline portion 140. For example, a hydraulic cylinder may connect to both lower incline portion 120 and upper incline portion 140 to control the folding and unfolding of each of those portions with respect to one another. As another example, a winch and pulley system can be employed to unfold and fold lower incline portion 120 with respect to upper incline portion 140. More specifically, in at least one embodiment, vehicle portion 180 includes a winch proximate hitch 192, such that the winch is connected to a pulley system used to erect and collapse the ramp.

FIG. 1C also illustrates that lower incline portion 120 includes one or more guardrails 128 which can fold flat onto lower incline portion 120 when the mobile action sports ramp 100 is put into a collapsed state.

Figure 1D:
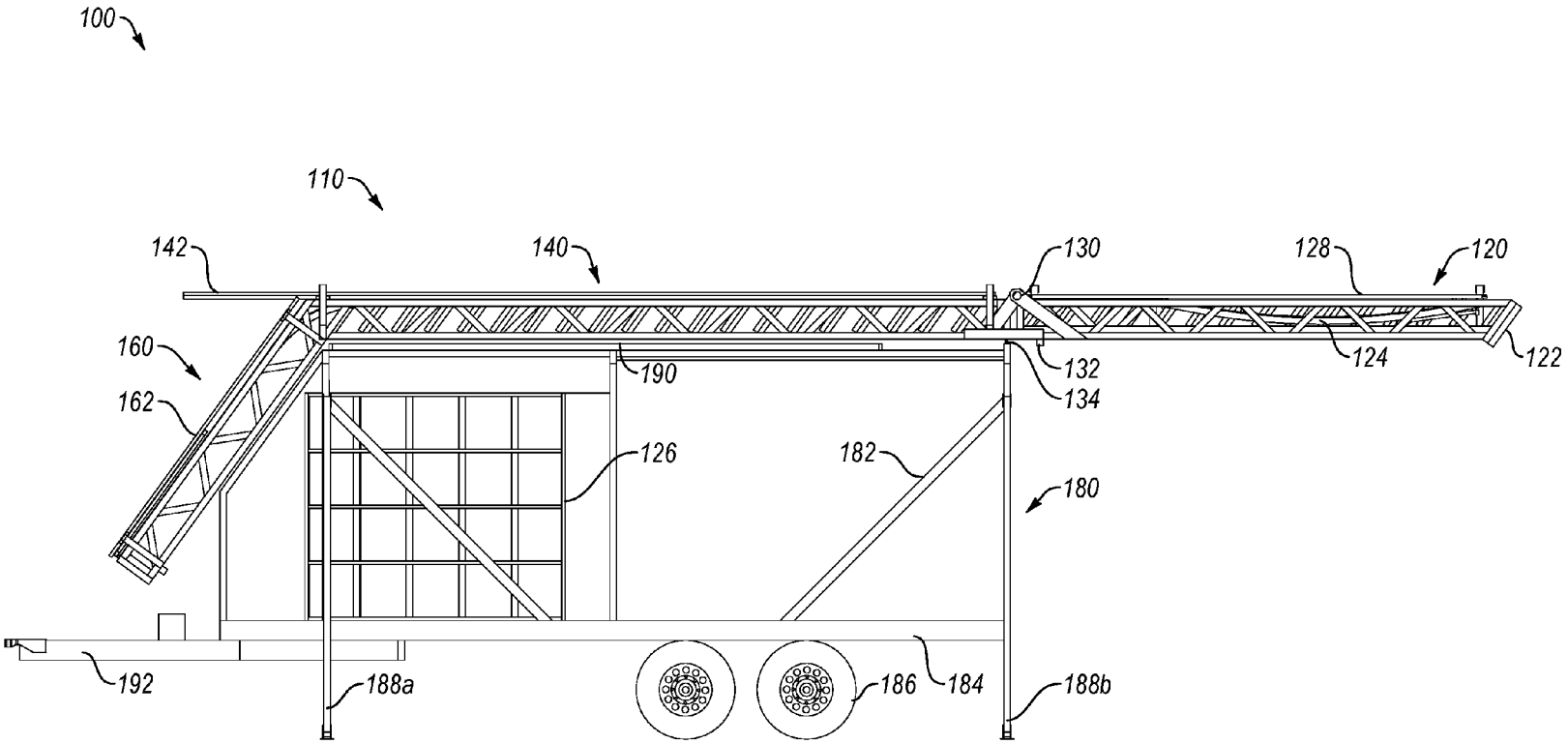
FIG. 1D is a left side view of the mobile action sports ramp of FIG. 1A in a second state of the process of erecting the mobile action sports ramp in accordance with embodiments of the present invention.

FIG. 1D is a left side view of the mobile action sports ramp 100 of FIG. 1A in a second state of the process of erecting the mobile action sports ramp 100 in accordance with embodiments of the present invention. More specifically, FIG. 1D shows that when erecting mobile action sports ramp 100, lower incline portion 120 rotates about hinge 130 until it is aligned with upper incline portion 140. In one or more embodiments, lower incline portion 120 rotates about hinge 130 until it reaches hinge block 132. In the embodiment shown in FIG. 1D, hinge block 132 is connected to upper incline portion 140. More specifically, hinge block 132 is a bar that extends to the rear end of upper incline portion 140 and spans the width of upper incline portion 140. Consequently, hinge block 132 serves the purpose of bearing at least a portion of the weight of lower incline portion 120, which then has a cantilever effect on upper incline portion 140 and platform portion 160 (i.e., the weight of lower incline portion 120 pressing down on hinge block 132 lessens the amount of force needed to lift incline portion 110 up into an erect state). Stated differently, lower incline portion 120 engages hinge block 132 to reduce the effort needed to erect upper incline portion 140 and platform portion 160.

FIG. 1D also shows that, in one or more embodiments, after lower incline portion 120 has been unfolded from upper incline portion 140, vehicle portion support members 188*a* and 188*b* can be removed from vehicle portion 180 and attached to vehicle frame 182 to provide improved stability for mobile action sports ramp 100. In one or more embodiments, vehicle portion support members 188*a* and 188*b* can include outriggers (i.e., bars) that connect to vehicle frame 182 by a double hinge (i.e., a hinge that allows each vehicle portion support member to move up and down, as well as towards and away from vehicle portion 180). Vehicle portion support members 188*a* and 188*b* can then engage a support surface (i.e., the ground) to provide improved stability of mobile action sports ramp 100.

Figure 1E:
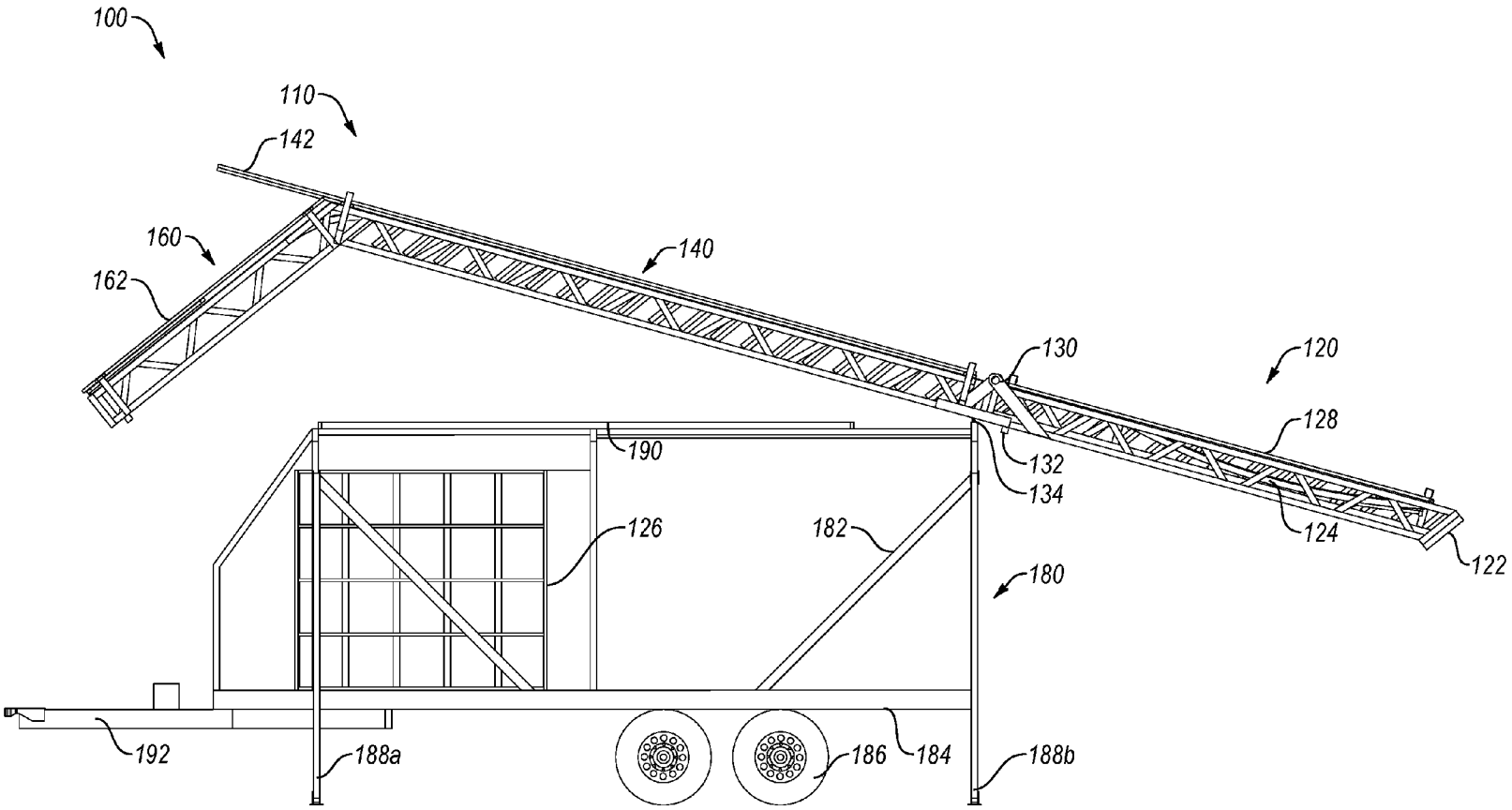
FIG. 1E is a left side view of the mobile action sports ramp of FIG. 1A in a third state of the process of erecting the mobile action sports ramp in accordance with embodiments of the present invention.

FIG. 1E is a left side view of the mobile action sports ramp 100 of FIG. 1A in a third state of the process of erecting the mobile action sports ramp 100 in accordance with embodiments of the present invention. In particular, FIG. 1E shows that, after lower incline portion 120 has been unfolded from upper incline portion 140, upper incline portion 140 rotates about hinge 134, and accordingly, incline portion 110 as a whole moves towards being substantially upright and erect. In one or more embodiments, the rotation, and ultimate erection, of incline portion 110 can be accomplished using manual labor. In other embodiments, one or more mechanical actuators may be employed to raise the incline portion 110 up from vehicle portion 180. For example, a hydraulic cylinder can be connected between upper incline portion 140 and vehicle portion 180 (e.g., at vehicle frame 182). Such a hydraulic cylinder can then actuate and control the raising and lowering of incline portion 110. As another example, a winch and cable system can be used to pull on the bottom end of lower incline portion 120, which would have the effect of raising incline portion 110 (e.g., by engaging hinge block 134 and using lower incline portion 120 to lever upper incline portion 140 and platform portion 160).

Figure 1F:
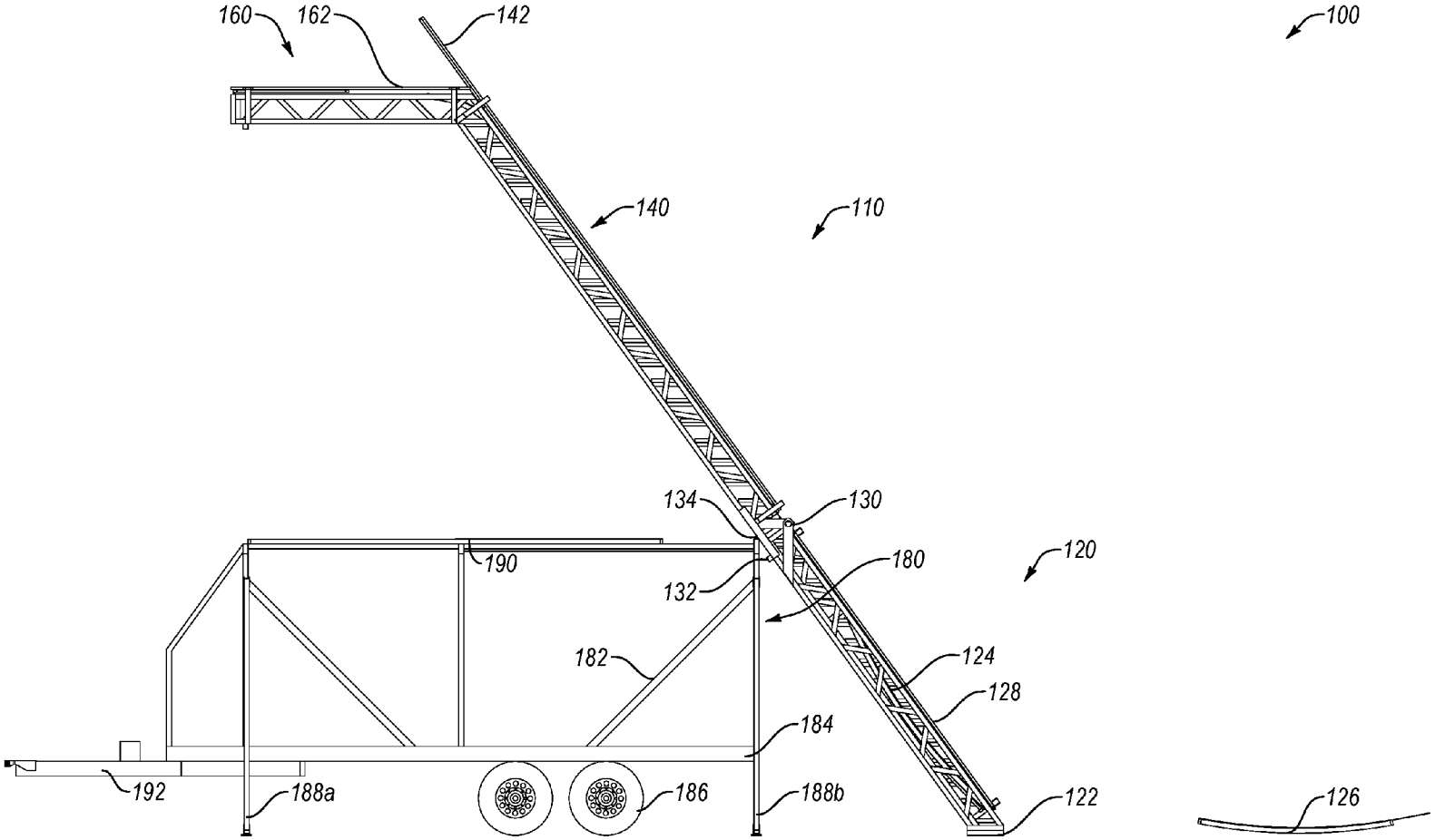
FIG. 1F is a left side view of the mobile action sports ramp of FIG. 1A in a fourth state of the process of erecting the mobile action sports ramp in accordance with embodiments of the present invention.

FIG. 1F is a left side view of the mobile action sports ramp 100 of FIG. 1A in a fourth state of the process of erecting the mobile action sports ramp 100 in accordance with embodiments of the present invention. As FIG. 1F shows, the incline portion 110 rotates about hinge 134 until foot 122 of lower incline portion 120 meets a support surface (i.e., the ground). Moreover, FIG. 1F illustrates that, in one or more embodiments, once incline portion 110 has completed rotating to meet a support surface, then ramp exit incline 126 can be removed from vehicle portion 180 in order to be later attached to incline portion 110.

Figure 1G:
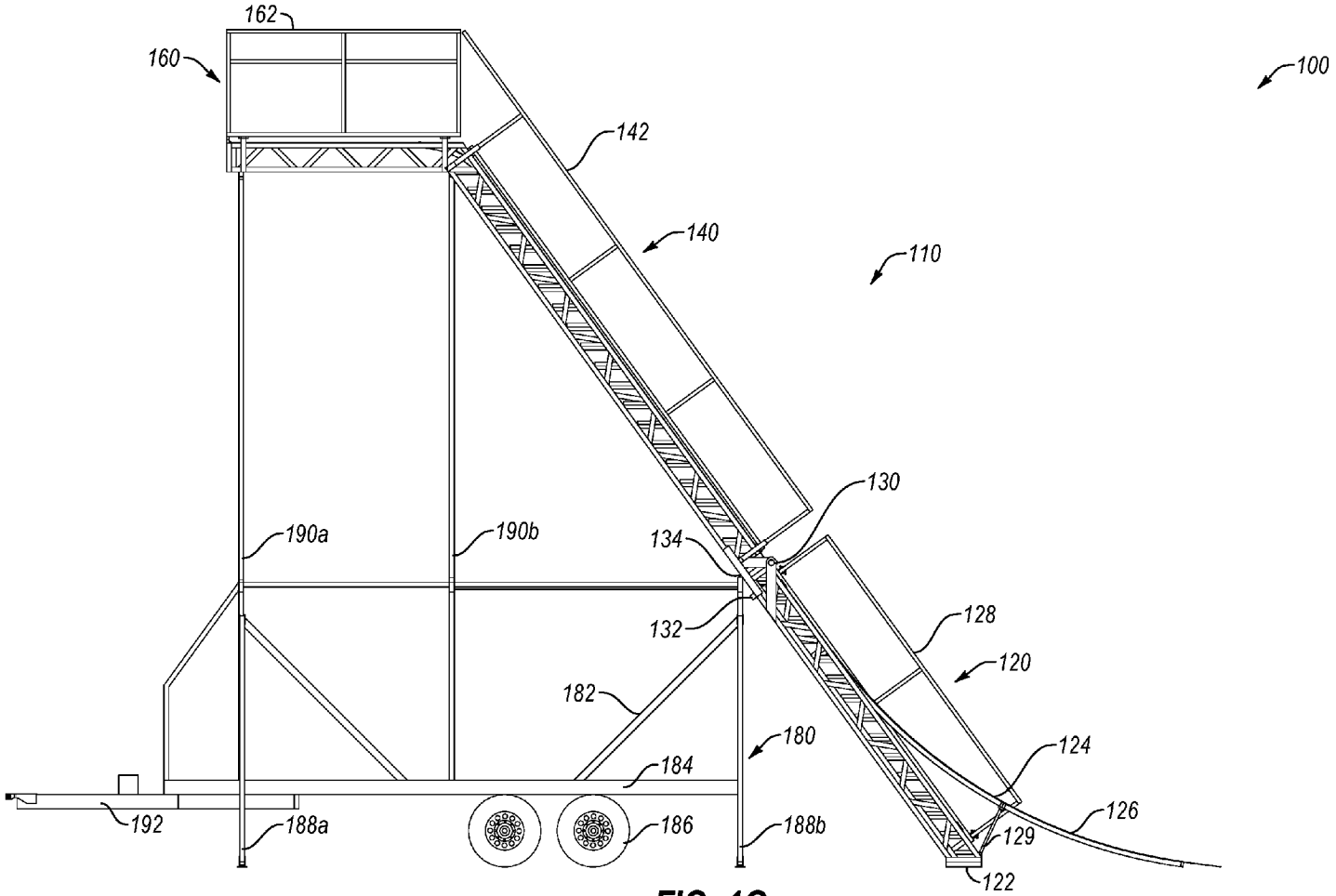
FIG. 1G is a left side view of the mobile action sports ramp of FIG. 1A in a fifth state of the process of erecting the mobile action sports ramp in accordance with embodiments of the present invention.

FIG. 1G is a left side view of the mobile action sports ramp 100 of FIG. 1A in a fifth state of the process of erecting the mobile action sports ramp 100 in accordance with embodiments of the present invention. FIG. 1G illustrates that, in one or more embodiments, after the incline portion 110 has rotated to meet a support surface, then incline portion support members 190*a* and 190*b* are raised to support incline portion 110 in the erect state. For example, in at least one embodiment, incline portion support member 190*a* is hingedly connected to vehicle frame 182. When mobile action sports ramp 100 is in a collapsed state, incline portion support member 190*a* is folded down onto the top of vehicle frame 182, whereas when mobile action sports ramp 100 is in the erect state as FIG. 1G shows, then incline portion support member 190*a* unfolds (e.g., rotates) up from vehicle frame 182 to connect to and support incline portion 110 (e.g., by connecting to platform portion 160). As another example, in at least one embodiment, incline portion support member 190*b* is hingedly connected to incline portion 110 (e.g., proximate a joint joining upper incline portion 140 and platform portion 160). Thus, when mobile action sports ramp 100 is in a collapsed state, incline portion support member 190*b* is folded in-between one or more trusses of upper incline portion 140 to be stored there. In contrast, when mobile action sports ramp 100 is in an erect state as FIG. 1G illustrates, then incline portion support member 190*b* rotates out from within upper incline portion 140 to connect to vehicle frame 182. In some embodiments, incline portion support members 190*a* and 190*b* are of fixed length, however, in other embodiments, incline portion support members 190*a* and 190*b* are of variable length (e.g., telescoping supports that shorten when mobile action sports ramp 100 is collapsed and extend when mobile action sports ramp 100 is erect).

Moreover, FIG. 1G shows that once mobile action sports ramp 100 is erect, then one or more guardrails 128, 142, and 162 can be unfolded from incline portion 110 to provide improved safety. In one or more embodiments, one or more guardrails 128, 142, and 162 are hingedly connected to incline portion 110. For example, guardrail 128 is hingedly connected to one side of lower incline portion 120, preferably a side of lower incline portion 120 proximate an integrated stairway. The hinged connections that connected one or more guardrails 128, 142, and 162 facilitate the folding and unfolding of such guardrails. In other embodiments, the one or more guardrails 128, 142, and 162 are erected by fitting into preexisting ports built into incline portion 110. For example, in an alternative embodiment, lower incline portion 120 can have one or more ports that receive support posts of guardrail 128, thereby holding guardrail 128 substantially upright.

Additionally, FIG. 1G illustrates that ramp transition incline 124 rotates out from within lower incline portion 120 to be supported by transition incline support member 129. Also, ramp exit incline 126 adjoins ramp transition incline 124 and, in one or more embodiments, ramp exit incline 126 is also supported by transition incline support member 129.

Figure 1H:
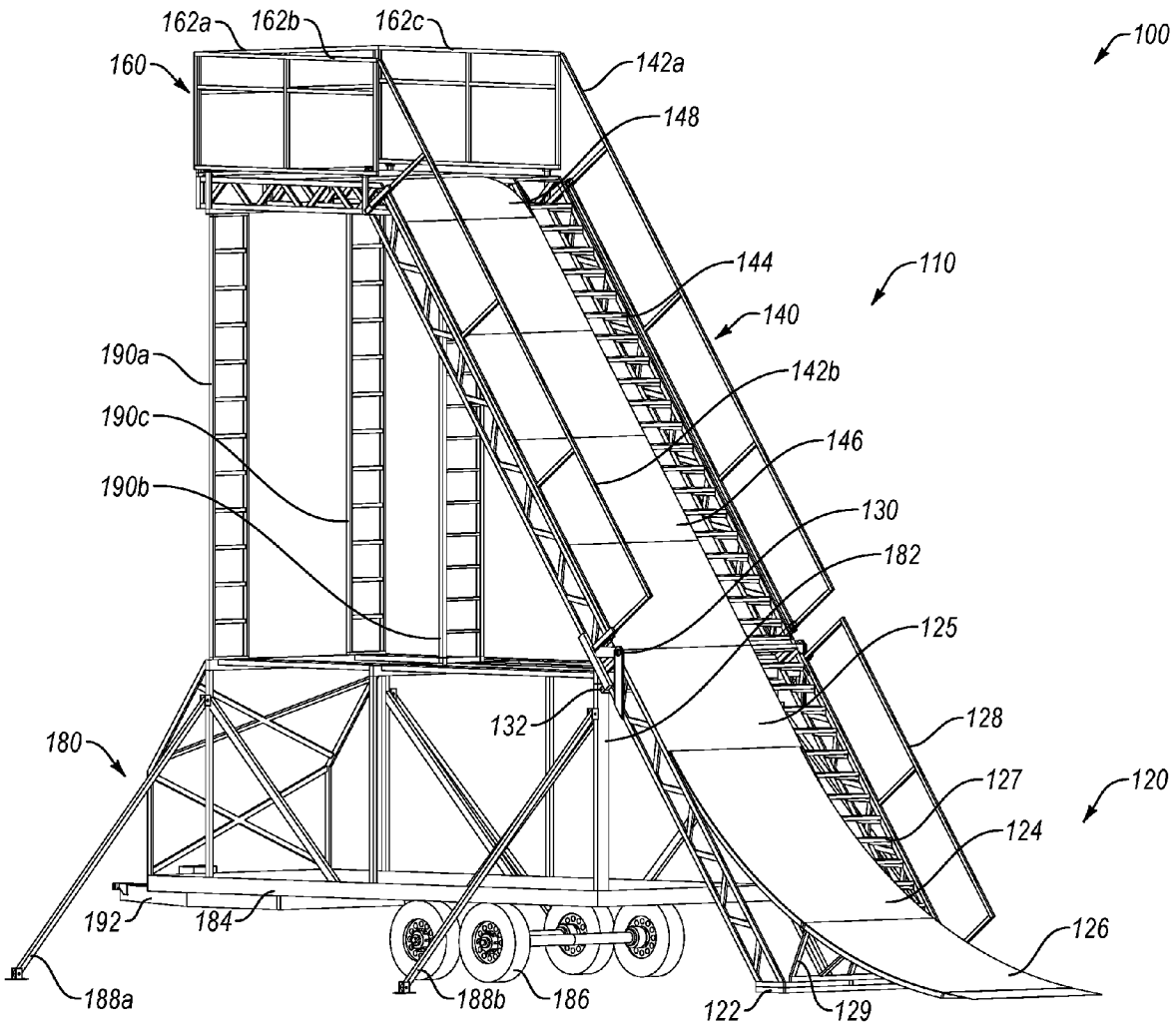
FIG. 1H is a first perspective view of the mobile action sports ramp of FIG. 1A in an erect state in accordance with embodiments of the present invention.

FIG. 1H is a first perspective view of the mobile action sports ramp 100 of FIG. 1A in an erect state in accordance with embodiments of the present invention. Similarly, FIG. 1I is a second perspective view of the mobile action sports ramp 100 of FIG. 1A in the erect state in accordance with embodiments of the present invention.

Figure 1I:
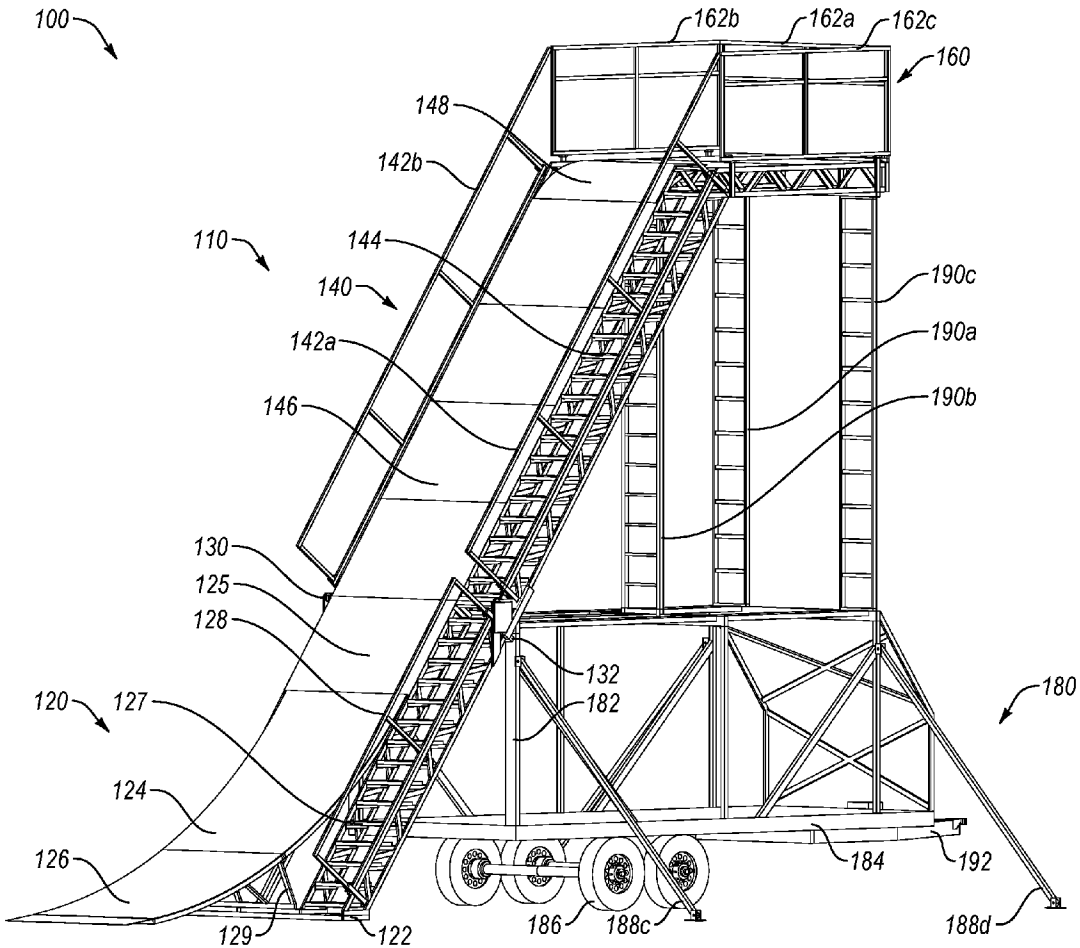
FIG. 1I is a second perspective view of the mobile action sports ramp of FIG. 1A in the erect state in accordance with embodiments of the present invention.

FIGS. 1H and 1I show additional aspects of one or more embodiments of the present invention. For example, FIGS. 1H and 1I show that platform portion 160 can include front guardrail 162*a*, left side guardrail 162*b*, and right side guardrail 162*c*, each of which is hingedly connected to platform portion 160 in order to fold down when mobile action sports ramp 100 is collapsed and up when mobile action sports ramp 100 is erect. Along similar lines, FIGS. 1H and 1I show that upper incline portion 140 can include left side guardrail 142*b* and right side guardrail 142*a*, each of which is hingedly connected to upper incline portion 140 in order to fold down or up as may be desired depending upon the state of mobile action sports ramp 100 (e.g., in a collapsed state or in an erect state). Likewise, FIGS. 1H and 1I illustrate that lower incline portion 120 can include a guardrail 128, which is hingedly connected to lower incline portion 120 to fold up or down.

FIGS. 1H and 1I also show that incline portion support member 190*a* can be positioned on the left side of vehicle portion 180, incline portion support member 190*b* can be positioned towards the middle of vehicle portion 180, and incline portion support member 190*c* can be positioned on the right side of vehicle portion 180. Furthermore, in one or more embodiments, incline portion support members 190*a*, 190*b*, and 190*c* can also serve as ladders, which facilitate the setup of mobile action sports ramp 100. Also, incline portion support members 190*a* and 190*c* can be hingedly connected to vehicle portion 180 in order to fold down when mobile action sports ramp 100 is in a collapsed state or to unfold up to connect to incline portion 110 when mobile action sports ramp 100 is in an erect state. Incline portion support member 190*b* can be hingedly connected to incline portion 110 in order to fold into and be stored by upper incline portion 140 when mobile action sports ramp 100 is in a collapsed state or to unfold and connect down to vehicle portion 180 when mobile action sports ramp 100 is in an erect state.

FIGS. 1H and 1I further illustrate that upper incline portion 140 and lower incline portion 120 can include integrated stairways 144 and 127, respectively. Such stairways provide improved safety by enabling users of mobile action sports ramp 100 to easily walk up and down the ramp.

Moreover, FIGS. 1H and 1I also show that upper incline portion 140 can include a ramp entry incline 148. In one or more embodiments, ramp entry incline 148 is a curved surface that provides a gradual entry down mobile action sports ramp 100. In other embodiments, ramp entry incline 148 could be flat and planar, lacking any curvature.

FIGS. 1H and 1I also show that upper incline portion 140 can include a ramp surface 146. Similarly, lower incline portion 120 can also include a ramp surface 125. In one or more embodiments, the ramp surfaces, such as ramp surface 146 and ramp surface 125 are permanently attached to their respective portions of the incline portion 110. In alternative embodiments, the ramp surfaces, such as ramp surface 146 and ramp surface 125, may be detachable from incline portion 110, thereby being attached to incline portion 110 when mobile action sports ramp 100 is in an erect state and stored on vehicle portion 180 when mobile action sports ramp 100 is in a collapsed state.

Additionally, FIGS. 1H and 1I show that ramp transition incline 124 and ramp exit incline 126 can be curved surfaces in at least one embodiment. In other embodiments, ramp transition incline 124 and ramp exit incline 126 can be substantially flat and not curved. Further, FIGS. 1H and 1I illustrate that transition incline support member 129 supports ramp transition incline 124 and ramp exit incline 126.

FIG. 1H also shows that on the left side of mobile action sports ramp 100, vehicle portion support members 188*a* and 188*b* extend out from vehicle portion 180 to provide improved stability. Similarly, FIG. 1I illustrates that on the right side of mobile action sports ramp 100, vehicle portion support members 188*c* and 188*d* extend out from vehicle portion 180 to also provide improved stability when the mobile action sports ramp 100 is erect. In one or more embodiments, when mobile action sports ramp 100 is collapsed, vehicle portion support members 188*a*, 188*b*, 188*c*, and 188*d* can be stored on vehicle portion 180 (e.g., by either being stored within vehicle frame 182 or by folding in and being stored against vehicle frame 182).

Figure 2:
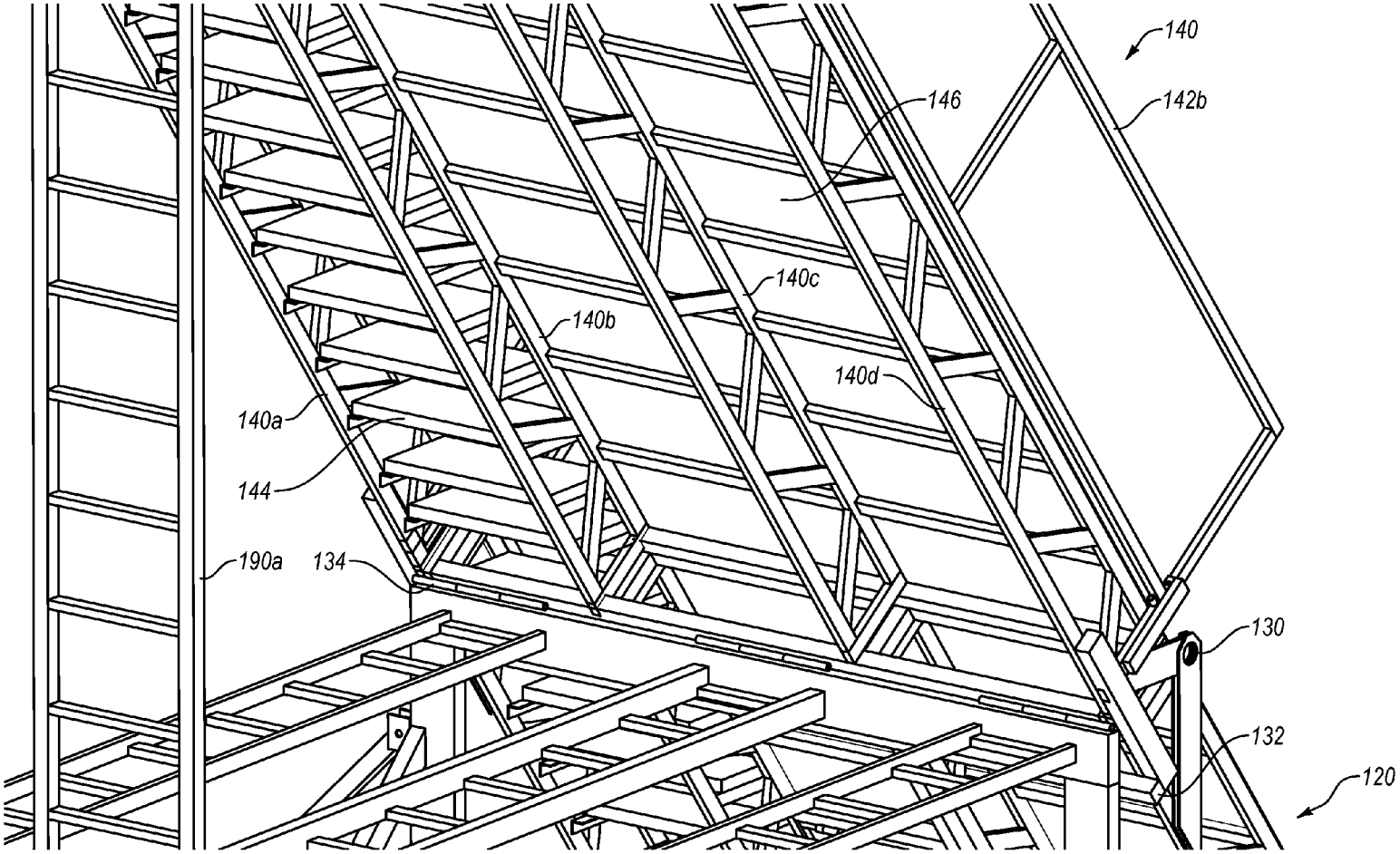
FIG. 2 is a detailed view of an upper incline portion and a lower incline portion of the mobile action sports ramp of FIG. 1A in the erect state in accordance with embodiments of the present invention.

FIG. 2 is a detailed view of upper incline portion 140 and lower incline portion 120 of the mobile action sports ramp 110 of FIG. 1A in the erect state in accordance with embodiments of the present invention. As FIG. 2 illustrates, lower incline portion 120 is connected to upper incline portion 140 by hinge 130 and lower incline portion 120 rotates about hinge 130. Further, in one or more embodiments, lower incline portion 120 rotates about hinge 130 until it reaches, or is blocked by, hinge block 132. Hinge block 132 can be a bar that is connected to upper incline portion 140 and spans the width of upper incline portion 140, such that lower incline portion 120 can rest and engage the bar.

Additionally, FIG. 2 illustrates that upper incline portion 140 is connected to a vehicle portion (e.g., at vehicle frame 182 of FIGS. 1A-1I) by a hinge 134. Hinge 134 enables upper incline portion 140 to rotate about in order to unfold mobile action sports ramp 100 into an erect state or to fold mobile action sports ramp 100 into a collapsed state.

Moreover, FIG. 2 shows that upper incline portion 140 includes trusses 140*a*, 140*b*, 140*c*, and 140*d*. Truss 140*c* is on the right side of mobile action sports ramp 100 and on one side of a stairway integrated into upper incline portion 140. Truss 140*b* is on a second side of the integrated stairway of upper incline portion 140 and truss 140*b* provides support to both the stairway and ramp surface 146. Truss 140*c* also provides support to ramp surface 146. Truss 140*d* is on the left side of mobile action sports ramp 100. As FIG. 2 shows, trusses 140*b*, 140*c*, and 140*d* can be connected together by cross-braces upon which ramp surface 146 attaches.

Figure 3:
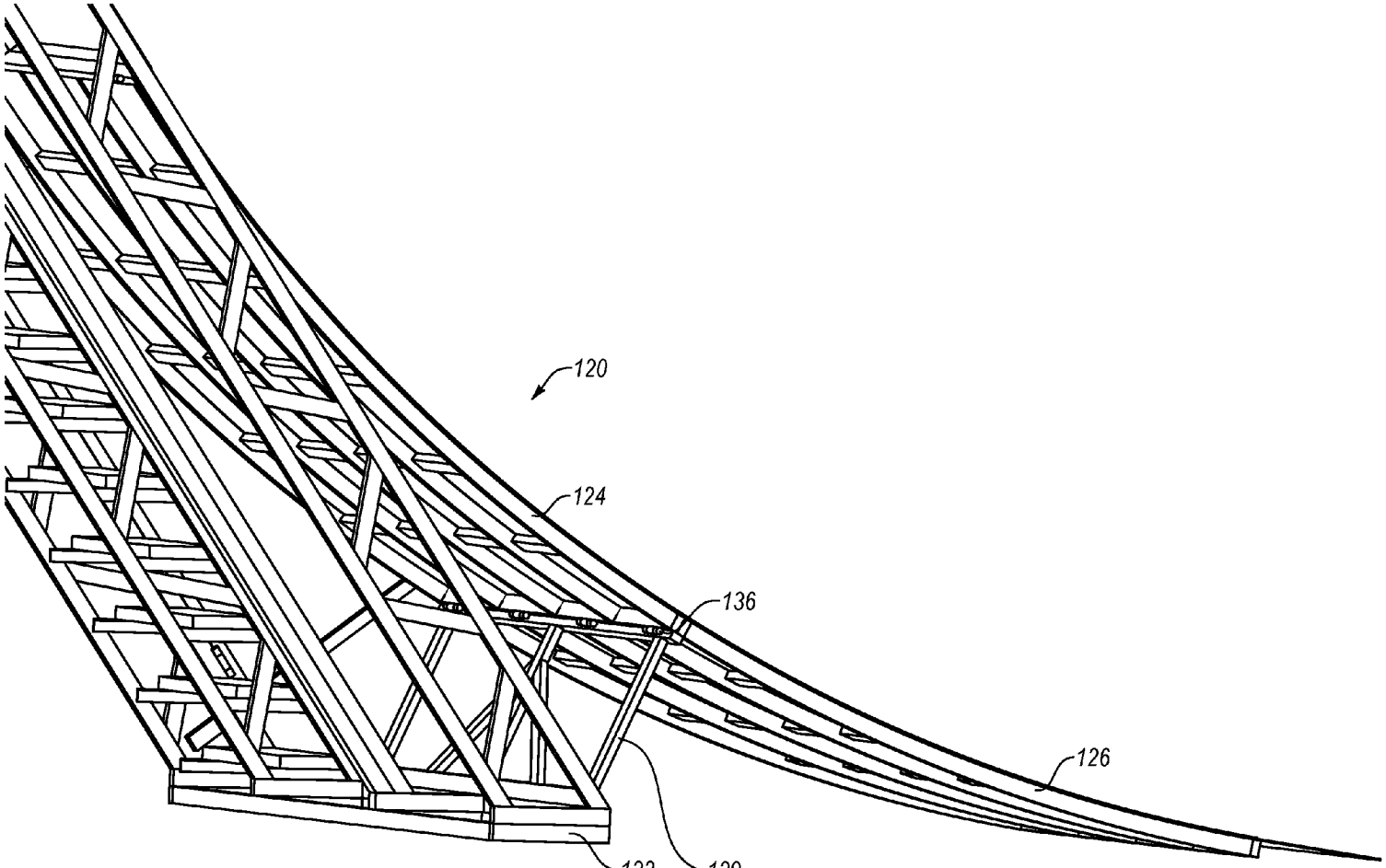
FIG. 3 is a detailed view of the lower incline portion of the mobile action sports ramp of FIG. 1A in the erect state in accordance with embodiments of the present invention.

FIG. 3 is a detailed view of the lower incline portion 120 of the mobile action sports ramp 100 of FIG. 1A in the erect state in accordance with embodiments of the present invention. In particular, FIG. 3 shows that transition incline support member 129 connects to ramp transition incline 124 by hinge 136. Accordingly, when mobile action sports ramp 100 is put into a collapsed state, transition incline support member 129 can fold onto the backside of ramp transition incline 124 (e.g., by rotating about hinge 136), and then both ramp transition incline 124 and transition incline support member 129 can be stored within lower incline portion 120. In contrast, when mobile action sports ramp 100 is erected, transition incline support member 129 can unfold from ramp transition incline 124 and rest upon a support surface (i.e., the ground). Further, FIG. 3 shows that transition incline support member 129 can also connect to and support ramp exit incline 126. In an alternative embodiment, transition incline support member 129 could be hingedly connected proximate foot 122, such that transition incline support member 129 could rotate about a hinge to fold into lower incline portion 120 or fold out to support ramp transition incline 124 or ramp exit incline 126 or both.

In addition to FIGS. 1A-1I, 2, and 3, embodiments of the present invention can also be described in terms of flowcharts of exemplary methods for accomplishing particular results. For example, FIG. 4 is a flowchart of an exemplary method for erecting a mobile action sports ramp in accordance with embodiments of the present invention and FIG. 5 is a flowchart of an exemplary method for collapsing a mobile action sports ramp in accordance with embodiments of the present invention.

Figure 4:
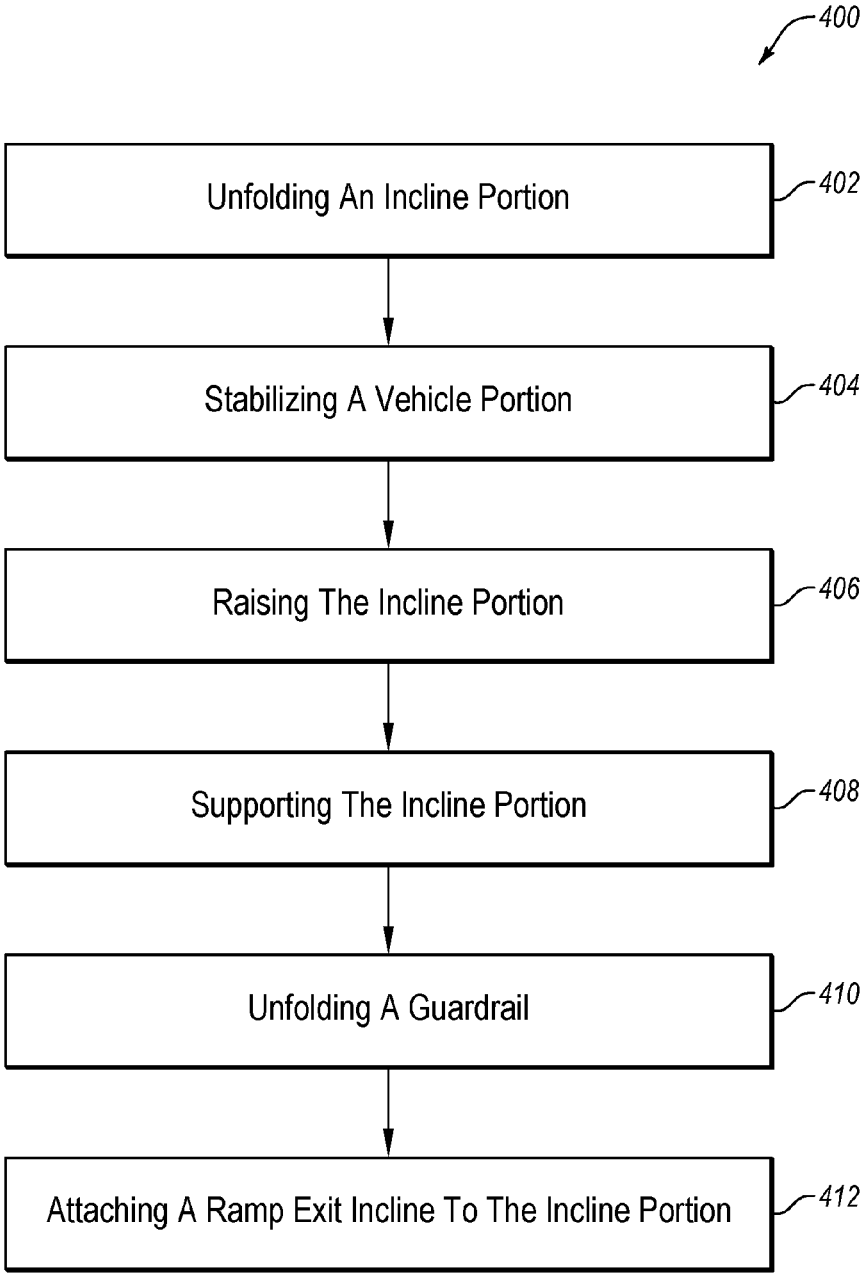
FIG. 4 is a flowchart of steps in a method for erecting a mobile action sports ramp in accordance with embodiments of the present invention.
Figure 5:
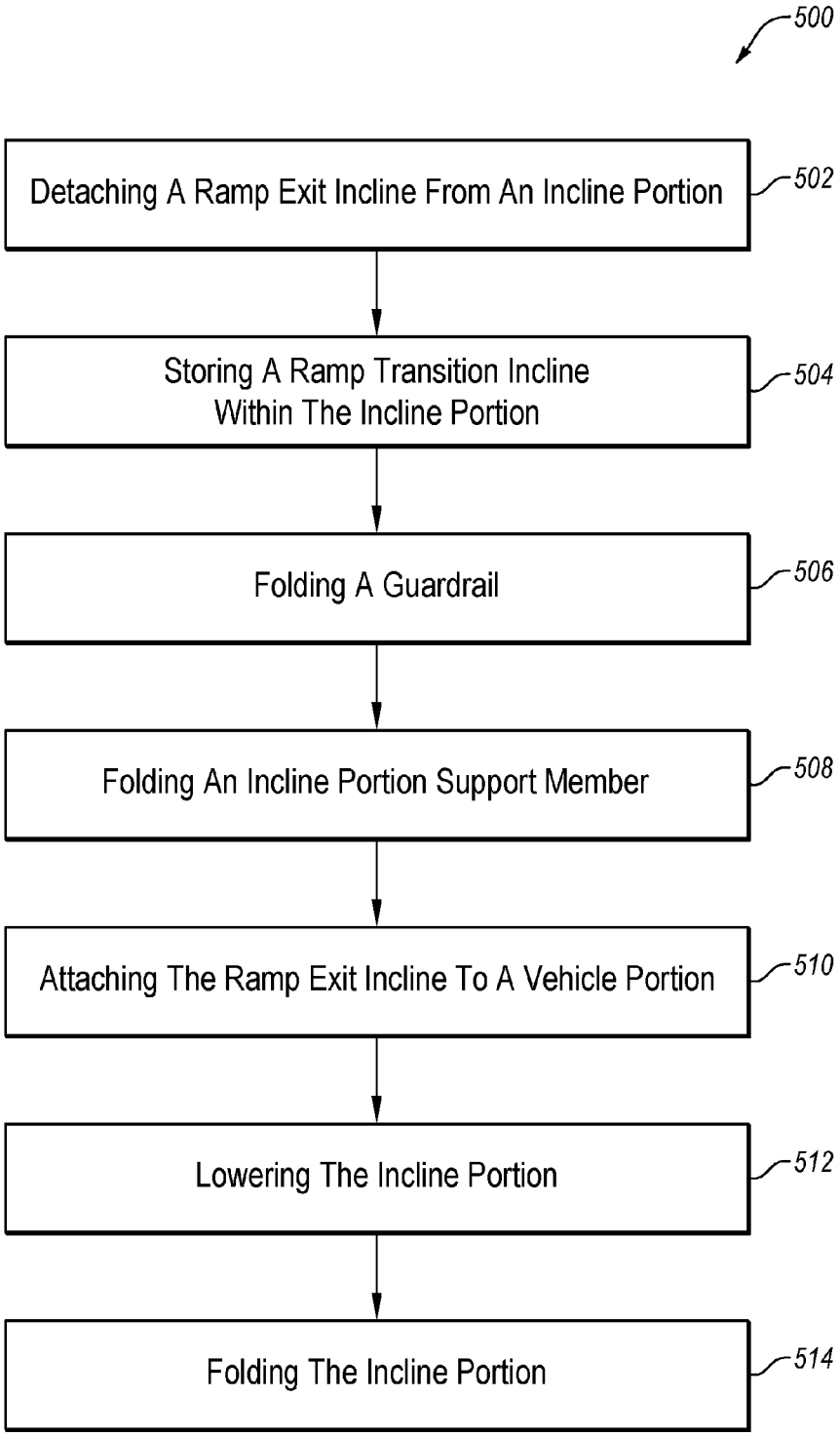
FIG. 5 is a flowchart of steps in a method for collapsing a mobile action sports ramp in accordance with embodiments of the present invention.

FIG. 4 is a flowchart of one exemplary method 400 for erecting a mobile action sports ramp. The method 400 includes a step 402 of unfolding an incline portion. More specifically, step 402 includes a step of unfolding an incline portion of the mobile action sports ramp by rotating a lower incline portion of the incline portion about a first hinge that connects the lower incline portion to an upper incline portion of the incline portion. Furthermore, step 402 can include a step of rotating the lower incline portion about the first hinge until the lower incline portion contacts a hinge block. Alternatively, step 402 can include a step of rotating the lower incline portion about the first hinge until the lower incline portion is aligned with an upper incline portion. Additionally, step 402 can include rotating the lower incline portion about the first hinge using a mechanical actuator. For example, step 402 can include rotating the lower incline portion about the first hinge using a winch and cable system or using a hydraulic cylinder.

Additionally, method 400 includes a step 404 of stabilizing a vehicle portion. In particular, step 404 includes a step of stabilizing the vehicle portion by attaching a vehicle portion support member to the vehicle portion such that the vehicle portion support member extends outwardly from the vehicle portion to a support surface. Furthermore, step 404 can also include a step of removing a vehicle portion support member from an internal cavity of a vehicle frame of the vehicle portion. Also, step 404 can include a step of attaching a vehicle portion support member to a double hinge of the vehicle frame.

Method 400 also includes a step 406 of raising the incline portion. More particularly, step 406 includes a step of raising the incline portion by rotating the upper incline portion about a second hinge that connects the upper incline portion to a vehicle portion of the mobile action sports ramp. Additionally, step 406 can include rotating the upper incline portion about the second hinge using a mechanical actuator, such as a hydraulic cylinder or winch and cable system.

Furthermore, method 400 includes a step 408 of supporting the incline portion. More specifically, step 408 includes a step of supporting the incline portion by connecting a first incline portion support member from the vehicle portion to the incline portion and connecting a second incline portion support member from the incline portion to the vehicle portion. Step 408 can also include a step of attaching a third incline portion support member from the vehicle portion to the incline portion. Additionally, step 408 can include rotating the second incline portion support member out from within the upper incline portion, such that the second incline portion support member is rotated about a hinge connected to the incline portion (e.g., at the platform portion or at the upper incline portion. Alternatively, step 408 can include connecting one or more telescoping vehicle portion support members between the vehicle frame and the incline portion.

Moreover, method 400 includes a step 410 of unfolding a guardrail. In particular, step 410 includes a step of unfolding a guardrail of the incline portion such that the guardrail is substantially upright. Even more specifically, step 410 can include a step of unfolding a first guardrail hingedly connected to a platform portion of the incline portion, a step of unfolding a second guardrail hingedly connected to the upper incline portion, and a step of unfolding a third guardrail hingedly connected to the lower incline portion of the incline portion.

Method 400 also includes a step 412 of attaching a ramp exit incline to the incline portion. Specifically, step 412 includes a step of attaching a ramp exit incline to the lower incline portion such that the incline portion provides a continuous ridable surface from a platform portion of the incline portion to an end of the ramp exit incline. Even more particularly, step 412 can include a step of attaching a ramp exit incline to a ramp transition incline of the lower incline portion. Additionally, step 412 can include a step of unfolding a transition incline support member of the lower incline portion to support the ramp exit incline and a ramp transition incline of the lower incline portion.

FIG. 5 is a flowchart of one exemplary method 500 for collapsing a mobile action sports ramp. The method 500 includes a step 502 of detaching a ramp exit incline from an incline portion. In particular, step 502 includes a step of detaching a ramp exit incline from a lower incline portion of the mobile action sports ramp. Even more specifically, step 502 can include a step of detaching the ramp exit incline from a transition incline support member and a ramp transition incline.

Moreover, method 500 includes a step 504 of storing a ramp transition incline within the incline portion. More specifically, step 504 includes a step of rotating a ramp transition incline of the incline portion such that the ramp transition incline is stored within the lower incline portion and a step of folding a transition incline support member of the lower incline portion such that the transition incline support member is stored within the lower incline portion. As one alternative, step 504 can include a step of rotating the transition incline support member about a hinge connected to the ramp transition incline. As another alternative, step 504 can include a step of rotating the transition incline support member about a hinge connected proximate a foot of the lower incline portion.

Additionally, method 500 includes a step 506 of folding a guardrail. More particularly, step 506 includes a step of folding a guardrail of the incline portion such that the guardrail is substantially laying on the incline portion. Even more particularly, step 506 can include a step of folding a first guardrail hingedly connected to the lower incline portion such that the first guardrail lays flat on the lower incline portion, a step of folding a second guard rail hingedly connected to the upper incline portion such that the second guardrail lays flat on the upper incline portion, and a step of folding a third guardrail hingedly connected to a platform portion such that the third guardrail lays flat on the platform portion.

Method 500 also includes a step 508 of folding an incline portion support member. Specifically, step 508 includes a step of folding a first incline portion support member onto the vehicle portion and a step of folding a second incline portion support member into the incline portion. Additionally, step 508 can include a step of disconnecting the first incline portion support member from the incline portion and a step of disconnecting the second incline portion support member from the vehicle portion. Step 508 can also include a step of folding an incline portion support member about a hinge connected to the incline portion such that the incline portion support member can be stored within the incline portion. Alternatively, step 508 can include a step of folding an incline portion support member about a hinge connected to the vehicle portion such that the incline portion support member can be stored on top of the vehicle portion.

Furthermore, method 500 includes a step 510 of attaching the ramp exit incline to a vehicle portion. In particular, step 510 includes a step of attaching the ramp exit incline to a vehicle frame of the vehicle portion.

Method 500 also includes a step 512 of lowering the incline portion. More specifically, step 512 includes a step of lowering the incline portion by rotating an upper incline portion of the incline portion about a first hinge that connects the upper incline portion to a vehicle portion of the mobile action sports ramp. Additionally, step 512 can include a step of lowering the incline portion using a mechanical actuator.

Moreover, method 500 includes a step 514 of folding the incline portion. In particular, step 514 includes a step of folding the incline portion by rotating a lower incline portion of the incline portion about a second hinge that connects the lower incline portion to the upper incline portion. Additionally, step 514 can include a step of folding the lower incline portion using a mechanical actuator.

In the foregoing specification, various embodiments have been described with reference to specific exemplary embodiments thereof. Various embodiments and aspects are described with reference to details discussed herein, and the accompanying drawings illustrate the various embodiments. The description above and drawings are illustrative and are not to be construed as limiting. Numerous specific details are described to provide a thorough understanding of various embodiments.

One or more embodiments of the present invention may be embodied in other specific forms without departing from its spirit or essential characteristics. The described embodiments of the present invention are to be considered in all respects only as illustrative and not restrictive. For example, the methods described herein may be performed with less or more steps or the steps may be performed in differing orders. Additionally, the steps described herein may be repeated or performed in parallel with one another or in parallel with different instances of the same or similar steps. The scope of the invention is, therefore, indicated by the appended claims rather than by the foregoing description. All changes that come within the meaning and range of equivalency of the claims are to be embraced within their scope.

What is claimed is:

1. A mobile action sports ramp comprising:

a vehicle portion;

an incline portion connected to the vehicle portion, the incline portion being rotatable between a collapsed state of the incline portion and an erect state of the incline portion; and an incline portion support member connected to the incline portion, the incline portion support member being rotatable between a collapsed state of the incline portion support member and an erect state of the incline portion support member;

a first mechanical actuator connected to the vehicle portion and the incline portion to move the incline portion between the collapsed state of the incline portion and the erect state of the incline portion;

a second mechanical actuator connected to the incline portion and a lower portion of the incline portion to move the lower portion between a collapsed state of the lower portion and an erect state of the lower portion;

a third mechanical actuator connected to the incline portion and the incline portion support member to move the incline portion support member between the collapsed state of the incline portion support member and the erect state of the incline portion support member; and a vehicle portion support member connected to the vehicle portion;

wherein, when the mobile action sports ramp is collapsed, the vehicle portion support member is stored on the vehicle portion; and wherein, when the mobile action sports ramp is erect, the vehicle portion support member extends outwardly from the vehicle portion.

2. The mobile action sports ramp as recited in claim 1, further comprising a vehicle frame that forms a storage area on the vehicle portion.

3. The mobile action sports ramp as recited in claim 1, further comprising a stairway integrated into the incline portion.

4. The mobile action sports ramp as recited in claim 1, further comprising a folding guardrail connected to the incline portion, the folding guardrail being rotatable between a collapsed state of the folding guardrail and an erect state of the folding guardrail.

5. The mobile action sports ramp as recited in claim 1, further comprising a ramp transition incline connected to the incline portion, the ramp transition incline being rotatable between a collapsed state of the ramp transition incline and an erect state of the ramp transition incline.

6. The mobile action sports ramp as recited in claim 1, further comprising a trailer hitch on the vehicle portion.

7. A mobile action sports ramp comprising:

a vehicle portion;

an upper incline portion connected to the vehicle portion by a first hinge;

a lower incline portion connected to the upper incline portion by a second hinge;

an incline portion support member connected to the upper incline portion by a third hinge;

a first mechanical actuator connected to the vehicle portion and the upper incline portion, the first mechanical actuator used to rotate the upper incline portion about the first hinge;

a second mechanical actuator connected to the upper incline portion and the lower incline portion, the second mechanical actuator used to rotate the lower incline portion about the second hinge;

a third mechanical actuator connected to the upper incline portion and the incline portion support member, the third mechanical actuator used to rotate the incline portion support member about the third hinge; and a vehicle portion support member connected to the vehicle portion;

wherein, when the mobile action sports ramp is collapsed, the upper incline portion, lower incline portion, and incline portion support member are horizontal upon the vehicle portion and the vehicle portion support member is stored on the vehicle portion; and wherein, when the mobile action sports ramp is erected, the incline portion support member is vertical upon the vehicle portion and the vehicle portion support member extends outwardly from the vehicle portion.

8. The mobile action sports ramp as recited in claim 7, further comprising:

a first stairway integrated into the upper incline portion; and a second stairway integrated into the lower incline portion.

9. The mobile action sports ramp as recited in claim 8, further comprising a platform portion connected to the upper incline portion.

10. The mobile action sports ramp as recited in claim 9, further comprising:

a first guardrail connected to the upper incline portion;

a second guardrail connected to the lower incline portion; and a third guardrail connected to the platform portion.

11. The mobile action sports ramp as recited in claim 7, further comprising a ramp transition incline connected to the lower incline portion.

12. The mobile action sports ramp as recited in claim 11, further comprising:

a ramp exit incline; and a transition incline support member connected to the ramp transition incline;

wherein, when the mobile action sports ramp is collapsed, the transition incline support member is stored within the lower incline portion and the ramp exit incline is stored on the vehicle portion; and wherein, when the mobile action sports ramp is erected, the transition incline support member supports the ramp transition incline and the ramp exit incline.

13. The mobile action sports ramp as recited in claim 7, wherein the vehicle portion is an enclosed trailer.

14. The mobile action sports ramp as recited in claim 7, wherein each of the first mechanical actuator, the second mechanical actuator, and the third mechanical actuator are a hydraulic cylinder.

15. A method for erecting an action sports ramp, the method comprising the steps of:

rotating a lower incline portion of the action sports ramp to horizontally align with an upper incline portion of the action sports ramp to form a continuous ramp surface;

rotating the lower incline portion and the upper incline portion about a first hinge to incline the continuous ramp surface;

rotating an incline portion support member of the action sports ramp about a second hinge to vertically support the upper incline portion;

rotating a ramp transition incline of the lower incline portion about a third hinge in a direction away from the lower incline portion; and attaching a ramp exit incline to the lower incline portion.

16. The method as recited in claim 15, further comprising the steps of:

rotating a first guardrail on the lower incline portion to be upright; and rotating a second guardrail on the upper incline portion to be upright.

17. The method as recited in claim 15, further comprising the step of rotating a transition incline support member of the lower incline portion to attach to the ramp transition incline and the ramp exit incline.

18. The method as recited in claim 15, further comprising the step of stabilizing the vehicle portion by extending a vehicle portion support member outwardly from the vehicle portion to a support surface.

* * * * *